United States Patent [19]

LeLande, Jr.

[11] Patent Number: 4,991,657

[45] Date of Patent: Feb. 12, 1991

[54] FIRE SUPPRESSION SYSTEM

[76] Inventor: Walter C. LeLande, Jr., 301 N. Hart Pl., Fullerton, Calif. 92631

[21] Appl. No.: 352,566

[22] Filed: May 16, 1989

Related U.S. Application Data

[63] Continuation-in-part of Ser. No. 908,808, Sep. 17, 1986, Pat. No. 4,836,290.

[51] Int. Cl.[5] ..... A62C 1/20

[52] U.S. Cl. ..... 169/46; 169/11; 169/13; 169/54; 169/61

[58] Field of Search ..... 169/43, 44, 9, 13, 14, 169/15, 27, 37, 46, 47, 54, 60, 61, 90, 11

[56] References Cited

U.S. PATENT DOCUMENTS

| | | | |
|---|---|---|---|
| 938,067 | 10/1909 | Maranville . | |
| 1,117,287 | 11/1914 | Warden . | |
| 1,806,829 | 5/1931 | Siebenmann . | |
| 2,207,662 | 7/1940 | Edmundson | 169/11 |
| 2,961,049 | 11/1960 | Toulmin, Jr. | 169/2 |
| 3,179,181 | 4/1965 | Banzato | 169/13 |
| 3,543,439 | 12/1970 | Pantland | 49/7 |
| 3,562,156 | 2/1971 | Francen | 252/8.05 |
| 3,583,490 | 6/1971 | McFadden | 169/60 |
| 3,588,893 | 6/1971 | McCloskey | 340/418 |
| 3,709,302 | 1/1973 | Stults et al. | 169/9 |
| 3,722,195 | 11/1973 | Francen | 252/8.05 |
| 3,762,477 | 10/1973 | Mobley | 169/14 |
| 3,779,317 | 12/1973 | Livingston | 169/60 |
| 3,829,010 | 8/1974 | Jones | 236/49 |
| 3,862,718 | 1/1975 | Butler | 236/49 |
| 3,912,223 | 10/1975 | Iwata | 169/60 |
| 3,957,658 | 5/1976 | Chiesa, Jr. et al. | 252/3 |
| 4,037,664 | 7/1977 | Gibson | 169/15 |
| 4,079,786 | 3/1978 | Moling | 169/61 |
| 4,091,874 | 5/1978 | Monma | 169/46 |
| 4,227,577 | 10/1980 | Iida | 169/61 |
| 4,272,414 | 6/1981 | Vandersall | 252/602 |
| 4,330,040 | 5/1982 | Ence et al. | 169/13 |
| 4,428,434 | 1/1984 | Gelaude | 169/13 |
| 4,432,272 | 2/1984 | Van Becelaere | 98/1 |
| 4,499,952 | 2/1985 | Spector et al. | 169/61 |
| 4,625,626 | 12/1986 | Aalto et al. | 98/1 |
| 4,723,481 | 2/1988 | Hart et al. | 98/121 |

FOREIGN PATENT DOCUMENTS

| | | |
|---|---|---|
| 671819 | 7/1979 | U.S.S.R. . |
| 1215724 | 3/1986 | U.S.S.R. . |

*Primary Examiner*—Sherman Basinger
*Assistant Examiner*—Stephen P. Avila
*Attorney, Agent, or Firm*—Fay, Sharpe, Beall, Fagan, Minnich & McKee

[57] ABSTRACT

A fire extinguishing system for roof fires or the like includes a fire sensor for monitoring a condition indicative of a fire and for signaling the sensing of the condition and a wind sensor for monitoring wind speed. A first fire extinguishing member is provided for spraying a fire retardant fluid onto an exterior surface of an associated roof. A control circuit is connected to the fire sensor and the first fire extinguishing member for actuating the first fire extinguishing member as driven by the fire sensor. The composition of the fire retardant fluid is regulated by the control circuit based on readings from the wind sensor.

36 Claims, 3 Drawing Sheets

FOAM
COMP. AIR
FOAM CONCENTRATE
$H_2O$ 3B
3B

FIRE SUPPRESSION SYSTEM

This is a continuation-in-part of copending application Ser. No. 908,808 filed on Sept. 17, 1986 now U.S. Pat. No. 4,836,290.

BACKGROUND OF THE INVENTION

This invention generally pertains to fire suppression systems. More specifically, the present invention relates to a fire suppression system for a building roof and an attic underneath the roof.

The invention is particularly applicable to fire suppression systems for wood shake, or shingle roofs. However, it will be appreciated by those skilled in the art, that the invention has broader applications and may also be adapted for use in many other fire suppression environments.

Commercial and industrial buildings are not solely dependent upon a community's local fire department as are residential areas. Business-type buildings are normally equipped with fire suppression systems and regularly conduct fire drills. Moreover, larger institutions usually maintain their own fire fighters and the necessary fire fighting equipment.

Unlike buildings of a commercial or industrial nature, however, residential buildings are almost never equipped with fire suppressant systems. This despite the fact that every residential dwelling is somebody's home and almost every item in the home is irreplaceable—the occupants, and the posessions—such as photograph albums and mementos and the like.

Wood shakes and shingles are frequently used in residential areas as roofing materials due to their attractive appearance. Usually such shakes or shingles are made of untreated cedar which dries out and becomes extremely flammable a few years after installation. Even when such shakes are treated with a fire suppressant chemical before installation, the shakes still dry out in a few years and become quite flammable. Such roofs in the drier southwestern and western areas of the United States are frequently dangerous fire hazards.

Wood shake roofs used on multi-unit residential dwellings in the dry regions of the sunbelt, such as in southern California, where numerous brush fires burn every year, are particularly dangerous. For example, in April, 1982 a 364 unit apartment complex in Anaheim, Calif. was destroyed by fire after a spark generated from lightning that struck a major electrical transformer started the cedar shake roofs of the apartment complex on fire. The complex had burned to the ground by the time the fire department arrived. Another fire related disaster occurred in Dallas in March of 1983. A large apartment complex having over 850 units was partially destroyed by fire when a faulty wiring system shorted out in the ceiling joists of one of the buildings and the sparks ignited the wood shingled roof. The flames spread quickly to all the roofs of the apartment complex and by the time the fire department arrived, 200 units of the complex had burned to the ground. There were also numerous injuries to firefighters and tenants, luckily, none were life threatening.

Southern California is plagued by brush fires attacking single family residences. In July 1985, in Baldwin Hills, a fashionable area of Los Angeles, a brush fire swooped down on a neighborhood of single family residences roofed with cedar shake shingles. The neighborhood was instantly ablaze. A couple of hours later, as the fire fighters doused the last smoldering embers, the neighborhood was in shambles. A total of 105 single family residences were lost and the lives of three residents were lost as well. In November of 1988, another brush fire struck Baldwin Hills. High winds of 40 to 50 miles per hour attacked and ignited the shingle roof of a single residence and the roof exploded into flame thereby igniting several nearby residential structures. By the time the fire fighters had arrived, four homes, each valued at $500,000–700,000 were destroyed.

It is believed that brush fires and the like which plague Southern California and are driven by the high velocity Santa Ana winds, constitute approximately 25% of the overall number of fire hazards afflicting wood shingle or shake roofs. The other 75% of the fires are caused by various factors such as lightning bolts, electrical fires or the like.

While several fire suppression systems are known for buildings and some chemical fire retardant treatment processes are known for wood shake roofs, none of these has been found to be entirely satisfactory in preventing the ignition and burning of wood shake or shingle roofs either in the brush fires which plague Southern California yearly or in accidental fires caused by lightning, electrical sparks or the like. Of course, accidental roof fires also occur in buildings which have asphalt shingle roofs.

Accordingly, it has been considered desirable to develop a new and improved fire suppression system for roofs, such as wood shake and shingle roofs, and the attics underneath them, which would overcome the foregoing difficulties and others while providing better and more advantageous overall results.

BRIEF SUMMARY OF THE INVENTION

In accordance with the invention, a new and improved fire extinguishing system is provided for roof fires or the like.

More particularly in accordance with this aspect of the invention, the fire extinguishing system comprises a fire sensor for monitoring a condition indicative of a fire and for signaling and sensing of the condition. A wind sensor is provided for monitoring wind speed. A first fire extinguishing means is adapted for spraying a fire retardant fluid onto an exterior surface of an associated roof. A control circuit is connected to the fire sensor, the wind sensor and the first fire extinguishing means for actuating the first fire extinguishing means as driven by the fire sensor. A composition of the fire retardant fluid is regulated by the control circuit based on readings from the wind sensor.

In accordance with another aspect of the invention, a fire extinguishing system is provided for protecting a building roof such as a wood shingle or shake roof, and the attic underneath the roof, from fire.

More particularly in accordance with this aspect of the invention, the system comprises a fire sensor for monitoring a fire condition, a supply of a fire retardant fluid and a supply of water. A fluid circuit is provided in which the fire retardant fluid and water can flow. A mixing means in the fluid circuit mixes the fire retardant fluid and the water to form a fire retardant mixture. A wind sensor is also provided. A plurality of nozzles are mounted on the building and connected to the fluid circuit downstream from the mixing means for spraying the roof with the fire retardant mixture upon the sensing of a fire condition by the fire sensor. The composition of the fire retardant mixture is determined by readings from the wind sensor.

In accordance with a further aspect of the invention, a method is provided for extinguishing a fire on a wood shingle or shake roof and in an attic underneath the roof.

More particularly in accordance with this aspect of the invention, the method comprises the steps of sensing a wind speed and sensing a fire condition. A fire retardant fluid is thereupon sprayed on the wood shingle roof. A composition of the fire retardant fluid is dependent upon the wind speed sensed.

In accordance with another aspect of the invention, the method further comprises the steps of providing an air flow path between the environment and the attic and, upon the sensing of a fire condition, actuating a closure means positioned in the air flow path for sealing the attic beneath the roof against the inflow of air through the air flow path. Thereupon, a fire retardant gas is injected into the attic.

One advantage of the present invention is its provision of a fire sensor for monitoring a condition indicative of a fire and a logic circuit connected to the fire sensor and to a fire extinguisher system for automatically actuating the fire extinguisher system as driven by the fire sensor.

Another advantage of the invention is the provision of a fire extinguishing system that sprays a fire retardant fluid onto an exterior surface of a roof, such as a wood shingle or shake roof to retard the combustion thereof.

Still another advantage of the present invention is its provision of a manually operable control means for overriding the logic circuit and manually activating the first fire extinguisher.

Yet another advantage of the present invention is the provision in a sealed attic, of at least one, and preferably two, ventilation fans for selectively circulating air through the attic when no fire condition is sensed. An air intake of each ventilation fan is closed by a closure means when a fire condition is sensed and thereupon a fire suppressant material is sprayed in the attic.

Yet still another advantage of the present invention is the provision of an emergency water supply for a fire extinguishing system so that the system can still function in the event that the municipal water supply is cut off.

A further advantage of the present invention is the provision of a wind sensor for monitoring wind speed. The readings of the wind sensor are utilized by a control circuit to determine the composition of the fire retardant fluid which will be sprayed on the roof.

A still further advantage of the present invention is the provision of a venturi nozzle which will allow a mixing of air, water, and a fire retardant chemical to create a fire fighting foam for a fire extinguishing system.

A yet further advantage of the present invention is the provision of a means to cut off the flow of a foam to the roof and allow only water to flow onto the roof at high wind speeds which would tend to blow the foam off the roof.

An additional advantage of the present invention is the provision of a flame detector which includes both an ultraviolet or spark sensor and an infrared or heat sensor. The sensors are connected in series such that actuation of both sensors is necessary to trip the flame detector.

A yet still further advantage of the present invention is the provision of an emergency power supply for powering a logic circuit of a fire extinguishing system even during power outages.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts a preferred embodiment of which will be described in detail in this specification and illustrated in the accompanying drawings which form a part hereof and wherein.

DETAILED DESCRIPTION OF THE PREFERRED EMBODIMENT

Figures 1, 1A:
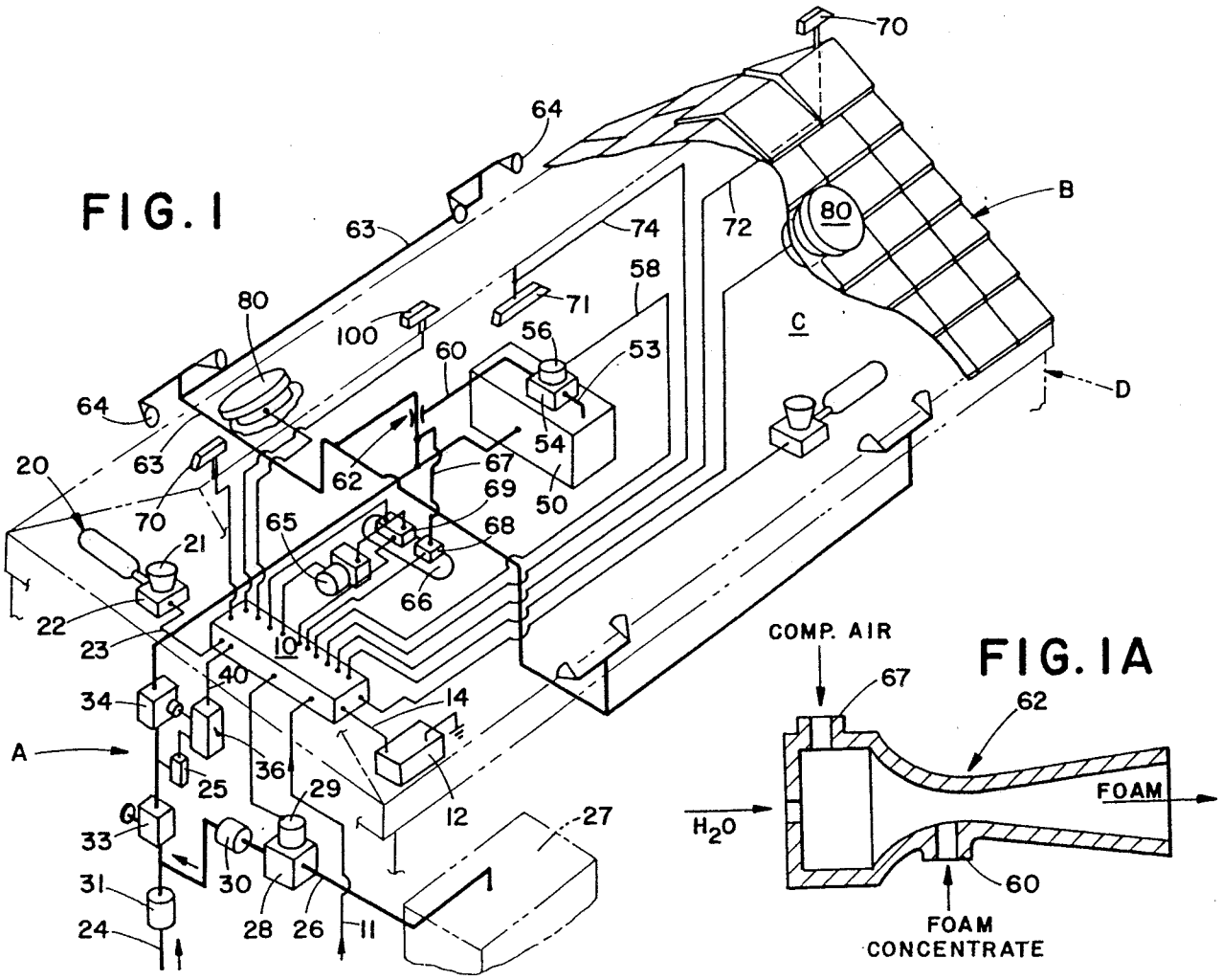
FIG. 1 is a schematic perspective view, partially broken away, of a fire suppression system and an associated roof and attic according to the present invention.
FIG. 1A is an enlarged cross-sectional view of a venturi nozzle for the fire suppression system of FIG. 1.

Referring now to the drawings wherein the showings are for purposes of illustrating a preferred embodiment of the invention only and not for purposes of limiting same, FIG. 1 shows the subject new fire suppression system A in schematic form positioned on a roof B overlying an attic C of a multi-unit building D. It should be appreciated that the building D could also be a single family residence. While the fire suppression system is primarily designed for and will hereinafter be described in connection with the suppression of fires occurring in wood shingle or shake roofs, or in attics beneath such roofs, it will be appreciated that the overall inventive concept involved could be adapted for use in other fire suppression environments such as, for example, asphalt-shingled roofs, and the like.

More particularly, the fire suppression system A comprises a control means 10, which can be a microcomputer or the like, that functions as the nerve center of the system. The control means 10 can be conventionally powered by the electrical supply 11 of the building D. If a fire occurs, however, such electrical supply may be interrupted. In order to provide power for the control means 10 in the event of an emergency, a conventional auxiliary power source 12, such as a battery, is also provided. A wiring connection 14 leads from the auxiliary power source to the control means.

A tank 20 of fire suppressant gas, such as $CO_2$, is also provided and is positioned in the attic C of the building D. The tank includes a nozzle 21 and a valve 22 which is actuated from the control means 10 by a lead wire 23. The function of the fire suppressant gas is to forestall or suppress any fires that may spread into the attic C, or that may start in the attic. The gas can be Halon instead of $CO_2$ if necessary for inhabited areas. If desired, two such tanks can be provided in the attic C as illustrated.

A water pipe 24 leads from the building's regular water supply to the attic. In case this supply is interrupted, such as by low water pressure during a fire, as sensed by a water pressure sensor 25 (see also FIG. 4), an auxiliary water supply pipe 26 is also provided. This pipe may provide water from an auxiliary source of water such as a swimming pool of the building D.

It should also be appreciated that the auxiliary water supply could be in the form of a tank of water, such as 27, kept nearby the premises for the purpose of fire fighting. This would be particularly advantageous in areas of the country which suffer fire problems on a nearly yearly basis, such as Southern California residences located in canyons that are plagued by brush fires. The tank 27 can have a capacity of 500 gallons if desired. Alternatively, the water could be from a well.

In order to urge the water from the auxiliary water supply up to the attic, a pump 28 is provided in the auxiliary water supply circuit. A motor control 29 activated by the control means 10 regulates the operation of the pump 28 and hence the flow of water through the auxiliary water pipe 26 once it is sensed that water is not flowing through the pipe 24 from the conventional water supply. A check valve 30 is provided in line 26 so that water from pipe 24 is not be allowed to flow away from the roof through pipe 26. Also pipe 24 should be shut and pipe 26 should be open when the pump 28 is actuated. In this regard, a one way check valve 31 is provided in the water line 24 upstream from pipe 26 for this purpose. A wiring lead 32 connects the motor control 29 to the control means 10.

It is estimated that at a flow rate of approximately 150 gallons per minute, it would take close to one-half hour to empty the auxiliary water supply if it is a conventional swimming pool, whether from a residential swimming pool onto a single family residence or from an apartment swimming pool or the like onto a multifamily residence roof. Of course, the tank 27 would be emptied much faster. Therefore, if only a tank were provided, the water flow rate could be set to a much lower figure, such as 25–30 gallons per minute at which rate it would take approximately 20 minutes to empty a 500 gallon tank 27.

Figures 2, 3A, 3B:
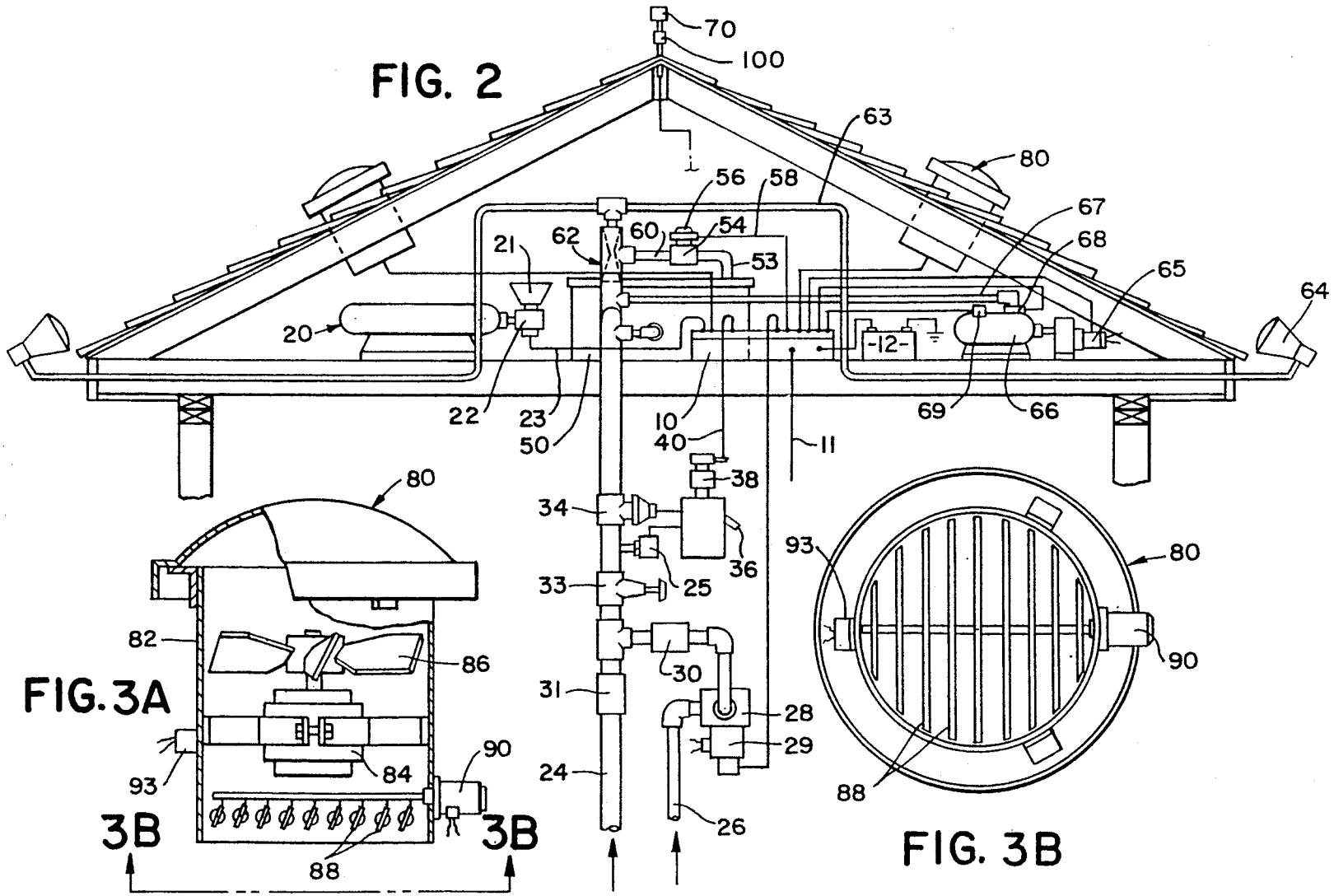
FIG. 2 is an enlarged side elevational view, in partial cross section, of the fire suppression system roof and attic, according to FIG. 1.
FIG. 3A is an enlarged side elevational view, partially in cross-section, of an attic ventilation fan according to the present invention.
FIG. 3B is an end elevational view of the fan of FIG. 3A.

With reference now also to FIG. 2, a manual shut-off valve 33 is provided in the water line or water pipe 24 downstream from the auxiliary water supply inlet to allow maintenance to be done on the system. A control valve 34 operated by the control means 10 is provided downstream of the manual shut-off valve 32. With reference now also to FIG. 2, the control valve can be manually tripped as at 36 when a fire condition is seen or anticipated so that reliance need not be had exclusively on the fire sensors which will be described below. On the other hand, the control means 10 can actuate the control valve 34 through an automatic trip means 38. A wiring lead 40 connects the control means 10 to the automatic trip means 38 and the sensor 25.

A fire suppressant liquid tank 50 is provided in the attic C and a water pipe 52 allows water to flow from the water conduit 24 into the tank to pressurize the liquid therein and cause it to flow through a pipe 53 and to a concentrator valve 54. The valve 54 is actuated by a conventional control solenoid 56 through a control wire 58 and controls the amount of fire suppressant fluid that is able to flow through a pipe 60 into a venturi eductor 62 positioned within the water pipe 24.

The eductor, which is better seen in FIG. 1A, enables a mixing of the fire suppressant fluid with water before the mixture flows through piping 63 and through a plurality of conventional nozzles 64 positioned on the exterior of the roof B.

The fire suppressant fluid may be a detergent foam, a protein foam, or an aqueous film forming foam such as the LIGHT WATER brand of aqueous film forming foam sold by 3M Corporation. Aqueous film forming foams are particularly advantageous in that they are designed to be used with water and, when proportioned with water and applied with conventional foam or water/fog equipment, the chemical generates a white foam with the ability to make water float on flammable liquids which are lighter than water. The foam spreads over the surface of the burning material forming a blanket in the manner of conventional foams. However, an aqueous solution drains from the foam bubbles and forms a vapor sealing film that floats on the surface of the burning matter and suppresses any volatile vapors, sparks, or the like. Preferably, the fluid has a low surface tension to thus provide excellent penetrating and wetting qualities which can be important in extinguishing wood shingle fires.

If the foam is of the type which requires the addition of air, such as the Ansul/Wormald SIL-VEX foam with wetting agents which has been used quite successfully to fight forest fires in Yellowstone National Park in 1988 as well as to fight brush fires in Southern California during the same time period, then a compressor motor 65 can be provided in the attic. The motor supplies air to a compressor tank 66 from which an air outlet pipe 67 leads to the venturi 62. The pipe 67 has positioned therein a valve 68 actuated by the microprocessor for controlling the amount of air flowing from the compressor tank 66. A compressor tank air pressure sensor 69 allows control of the pressure the tank 66 is held at.

The SIL-VEX foam is said to adhere considerably better than any other foam on the market and is also advantageous because of the fact that it needs considerably less water to activate it than other foams, since it can be used with the air compressor mentioned above. The foam dispensed can be as thick as shaving cream but is biodegradable in order not to cause any injury to the environment. The foam is sticky and adheres to the roof surface or any other surface that it contacts.

Other suitable foams could Fire Trol Fire Foam sold by Chemonics Industries, Forexpan foam sold by Angus Fire Armour Corp. and Phos-Chek WD861 sold by Monsanto Co.

It is noted that the nozzle heads 64 are located down in the fascia, i.e., the board trim, of the roof as shown in FIG. 2, in order to use the roof itself as a backstop. In this way, the foam is splashed and delivered to cover the most roof surface in a rapid fashion. Additionally, the nozzle heads thus present a low profile in order not to detract from the aesthetically pleasing appearance of the roof.

A plurality of sensors or detectors 70 are provided for sensing a fire condition on the roof B. Two of these are preferably positioned on the outer surface of the roof, for example one adjacent each end thereof, while a third inner detector 71 is preferably positioned at the apex of the attic C to sense any fire in the attic. Preferably, the outer detectors 70 or flame detectors each comprise an ultraviolet sensor and an infrared sensor which are connected in series. In this way, actuation of both sensors is necessary in order to trip the flame detector. This is advantageous because the ultraviolet sensor will sense sparks or the like whereas the infrared sensor will sense heat. Only if both are sensed will the flame detector send a signal to the control means 10 that there is a fire in progress. This construction is used to eliminate false alarms caused by, for example, lightning bolts or the spark of a welding torch, or the like.

The inner sensor 71, however, can be only a heat detector or infra red sensor and need not employ an ultraviolet sensor.

Suitable infrared sensors can be purchased from Amperex Co. of Smithfield, R.I. or Marktech International of Menands, N.Y. However, instead of using an infrared sensor, one could also use a temperature sensor such as a snap action disc thermostat of the type sold by Selco Products Co. of Buena Park, Calif. Ultra-violet sensors can be purchased from Silonex Inc. of Plattsburgh, N.Y. Suitable wiring 72, 74 leads from each of the sensor means 70, 71 to the control means 10. Of course more or less than three such sensors 70, 71 could be provided as circumstances dictate.

In order to retard the spread of fire in the attic C, the attic is preferably sealed by closing all outside air sources such as by blocking all the air vents. This diminishes air movement in the attic. However, since stagnant air in the attic would, in the summertime, get quite hot, a pair of ventilation fans 80 are provided for the roof B to establish an air circulation pattern in the attic C to cool it.

With reference now to FIG. 3A, each of these fan assemblies 80 includes a housing 82, a motor 84, several (see fan blades 86, as well as louvers or shutters 88, and a control solenoid 90. Suitable wiring 92 leads from the control means 10 to the solenoid. A suitable conventional thermostat 93 (see also in FIG. 4) can be provided in the attic to actuate each fan's motor 84 when the temperature in the attic climbs past a selected temperature. It should be noted that the sensor means 70 can be suitably configured to also function as the thermostat for the regulation of the fan assemblies 80 when no fire condition is sensed. When, however, the sensor means 70 senses a fire condition, the solenoid 90 is actuated through the control means 10 to close the shutters 88 (see FIG. 3B) and thereby prevent any further air circulation into or out of the attic through the fan assemblies 80.

Further provided on the exterior surface of the roof, preferably at the peak of the roof, is a wind velocity sensor 100 for sensing wind speeds. When the wind reaches speeds that would blow the foam off the roof, then the wind sensor will close the mixing valve 54 altogether. This will mean that only water will flow through the venturi eductor thereby delivering only water to the nozzles 64. This conserves the foam supply at high wind speeds which would tend to blow the foam off the roof thereby rendering it useless.

In order not to shut off the flow of foam during gusty wind conditions, instead of a sustained high wind, the software programming in the microcomputer can be so set as to delay the shut off of the mixing valve 54 for approximately 30–60 seconds. In this way, only a sustained wind speed above, e.g. 50 mph for one minute, will shut off the flow of foam by closing the valve 54.

However, as mentioned, the water is preferably delivered to the nozzle heads and discharged at a fairly high pressure, such as approximately 150 psi, in order that the water not be blown away from the roof even at high wind speeds of 50 mph or more. It should be noted that such wind speeds are common during the so-called Santa Ana winds which blow every year in Southern California fanning brush fires. While the wind speed sensor can be set to any desired wind speed, it is contemplated that the sensor ought to be set to about 30–35 miles per hour. In other words, wind speeds above that speed will actuate the control means to shut off the mixing nozzle 54 so that only water will flow onto the roof under those circumstances.

The wind speed sensor can be adapted from a conventional pilot tube design used on airplaces. Alternatively, certain meteorological instruments are currently available to measure wind speed and one of these could be utilized.

In high winds only water will flow to soak the wood shingle or shake roof. It is estimated that it would take approximately 15 minutes to thoroughly soak the wood shingle or shake roof with water so that the roof would no longer be flammable. As previously mentioned, it is estimated that it would take close to half an hour to empty out an auxiliary water storage supply, such as a swimming pool while soaking the roof with water. At a flow rate of 25 or 30 gallons per minute, it would take approximately 20 minutes to empty the 500 gallon auxiliary storage tank mentioned above. In this way, roof fires can be prevented even in a brush fire situation during high winds. It is also estimated that despite the rapid evaporation of water from the roof caused by the high winds, a water soaked roof will prevent the start or spread of fires on the roof for at least five (5) or six (6) hours.

Figure 4:
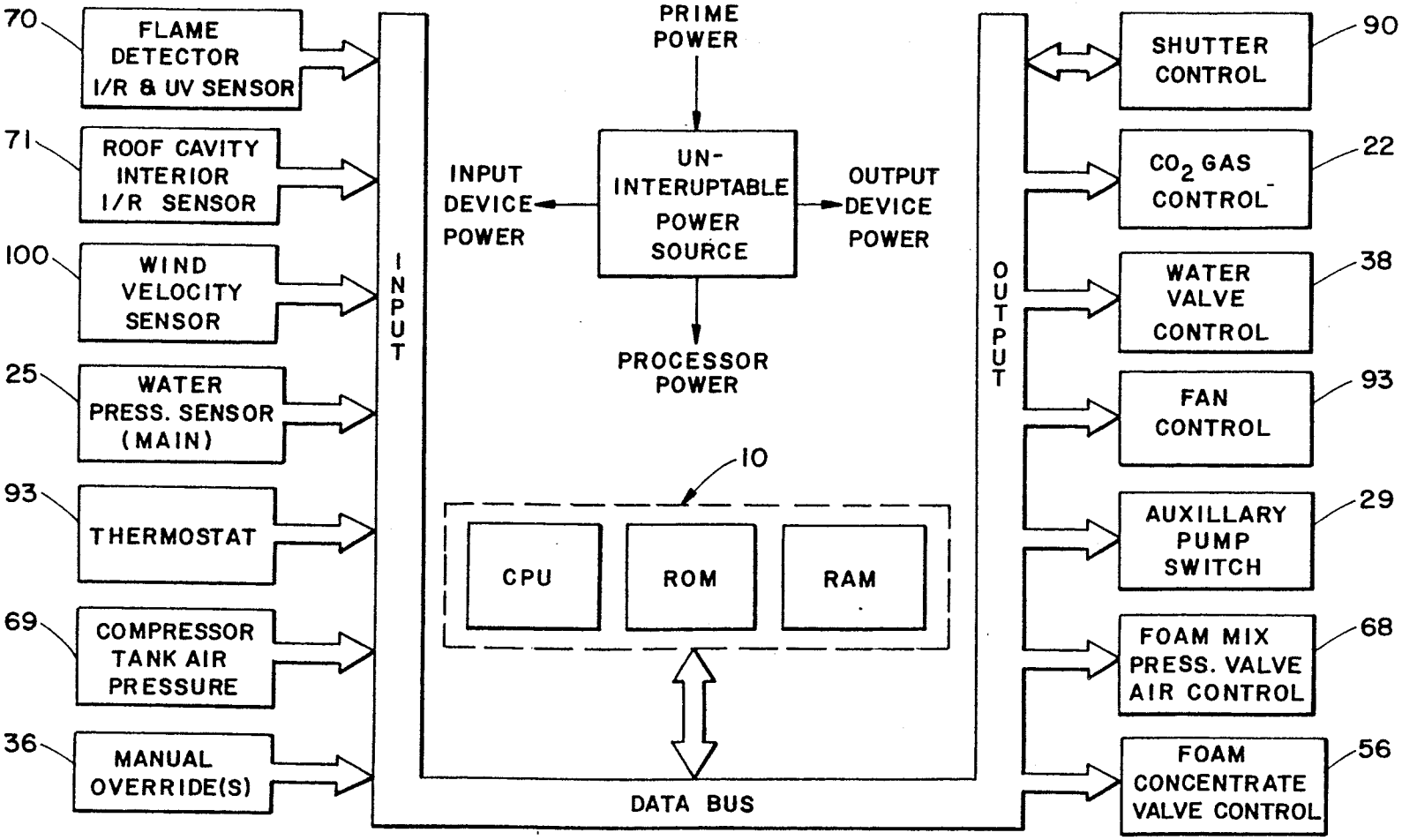
FIG. 4 is a schematic diagram of a control means and the inputs and outputs thereof, which control means operates the fire suppression system of the present invention.

In use, and with reference now also to FIG. 4, when a fire condition is sensed by the sensor means 70, 71 or when the manual trip 36 is activated, power to the motors 84 of the fan assemblies is shut-off and the shutters 88 are closed thereby preventing any further air circulation in the attic C. The control means 10 then actuates the valve 22 of the fire suppressant gas to allow gas to flow out of tank 20 through nozzle 21 and fill the attic with a fire retardant or suppressant gas, such as $CO_2$. It is conceivable that the tank could be filled with a material which will foam upon release into the attic. Such a material would also suffice for retarding or suppressing attic fires.

Simultaneously, the automatic trip 38 is actuated by the control means 10 (unless already previously actuated by manual trip 36) to open control valve 34 and allow water to flow through the water pipe 24. Assuming that the wind speed is fairly low, fire suppressant fluid from tank 50 is urged to flow into and be mixed with the water in the venturi eductor 62 from which the water and fire suppressant fluid combination flows through piping 63 and nozzles 64 onto the shingles on the exterior of the roof B. If the shingles are already burning, then the water-fire suppressant fluid mixture will tend to put the flame out. If the shingles are not yet ignited, then the mixture will tend to prevent such ignition from taking place. Thus the potential roof fire is either prevented from occurring at all or is extinguished very quickly thereby saving the roof of the building and hence the living units therewithin.

The foam film leaves a coating on the shingles to prevent any secondary or back firing, a common occurrence with brush fires that are propelled by shifting winds. It is estimated that the film coating on the shingles will be effective as long as sixteen (16) hours. As previously mentioned, even in high winds, it is estimated that the water soaking of a wood shingle or shake roof will be effective for five (5) or six (6) hours.

It should be noted that if the manual trip 36 is activated, the control means will sense this and actuate the valve 22 of the fire suppressant gas in the attic just as with the automatic operation thereof.

The provision of a manual switch or trip 36 is advantageous, especially in systems that are to be installed in Southern California. In this area, brush fires rage out of control for days on end although not threatening residential communities. Then, without warning, the wind direction changes and the fire swoops down on a residential area. The manual switch 36 will act as a preventative measure under these circumstances allowing the residence owner to switch on the system prior to being attacked by the brush fire.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

Having thus described the preferred embodiments, the invention is now claimed to be:

1. A fire extinguishing system for roof fires or the like, comprising:

a fire sensor for monitoring a condition indicative of a fire and for signaling the sensing of the condition;

a wind sensor for monitoring wind speed;

a first fire extinguishing means for spraying a fire retardant fluid onto an exterior surface of an associated roof; and, a control circuit connected to said fire sensor, said wind sensor and said first fire extinguishing means for actuating said first fire extinguishing means as driven by said fire sensor, wherein a composition of the fire retardant fluid is regulated by said control circuit based on readings from said wind sensor.

2. The system of claim 1 wherein said fire sensor comprises:

an ultra-violet sensor; and, an infrared sensor, said ultra-violet and infra-red sensors being connected in series such that actuation of both of said sensors is necessary to trip said fire sensor.

3. The system of claim 1 wherein said first fire extinguishing means comprises:

a spray nozzle;

a fluid circuit;

a fire retardant fluid holding tank; and, a valve for controlling the flow of a fire retardant fluid from said holding tank through said fluid circuit to said spray nozzle.

4. The system of claim 3 wherein said first fire extinguishing means further comprises:

a source of water;

a water conduit connecting said source of water to said fluid circuit; and, mixing means located in said fluid circuit for mixing water from said source of water with said fire retardant fluid before said mixture exits through said spray nozzle.

5. The system of claim 4 wherein when said wind sensor senses a wind speed above a given speed, said control circuit will close said fire retardant fluid valve so that only water will flow through said mixing means and exit through said spray nozzle.

6. The system of claim 4 wherein said source of water is an emergency water supply.

7. The system of claim 6 further comprising a pump for pumping water from said emergency water supply to said water conduit, said pump enabling water to exit said spray nozzle at a high rate.

8. The system of claim 1 further comprising a manually operable control means for overriding said control circuit and activating said first fire extinguishing means.

9. The system of claim further comprising a second fire extinguishing means comprising:

a fire retardant gas storage container;

a valve means for controlling the venting of fire retardant gas from said container into an associated attic located under said associated roof; and, a control wire connecting said valve means to said control circuit.

10. The system of claim 1 further comprising at least one ventilation fan for selectively circulating air through an associated attic located under the associated roof when no fire condition is sensed in order to cool the associated attic.

11. The system of claim 10 further comprising a closure means for closing an air intake of said at least one ventilation fan, when a fire condition is sensed.

12. The system of claim 1 further comprising an emergency power supply for powering said logic circuit even during power outages.

13. A fire extinguishing system for protecting a building roof such as a wood shingle or shake roof, and the attic underneath the roof, from fire, comprising:

a fire sensor for monitoring a fire condition;

a supply of fire retardant fluid;

a supply of water;

a fluid circuit in which said fire retardant fluid and water can flow;

a supply of air;

a mixing means in said fluid circuit for mixing said fire retardant fluid, said air and said water to form a fire retardant mixture wherein said mixing means comprises a venturi eductor having a water inlet, a fire retardant fluid inlet, an air inlet and an outlet; and, a plurality of nozzles mounted on the building and connected to said fluid circuit downstream from said mixing means for spraying the roof with the fire retardant mixture upon the sensing of a fire condition by said fire sensor.

14. The system of claim 13 further comprising:

a ventilation fan extending through the roof and defining an air path into and out of the attic, said fan including a frame and a selectively operable means secured to the frame for moving air through the air path;

a temperature sensor associated with said fan for monitoring an overtemperature condition in the attic and for monitoring a fire condition;

a second means for selectively closing the air path of said ventilation fan and deenergizing said means for moving air through the air path as directed by said temperature sensor when a fire condition is sensed.

15. The system of claim 14 further comprising:

a fire retardant gas storage container;

a valve for regulating the venting of fire retardant gas from said container into the attic; and, a means for controlling the operation of said valve.

16. The system of claim 13 wherein said fire sensor comprises:

an ultra-violet sensor; and, an infra-red sensor, said ultra-violet and infra-red sensors being connected in series such that actuation of both of said sensors is necessary to trip said fire sensor.

17. The system of claim 13 further comprising a manual control member for actuating the fire extinguishing system manually even if no fire condition is sensed by said fire sensor.

18. A method for extinguishing a fire on a wood shingle or shake roof and in an attic underneath the roof, the method comprising the steps of:

sensing a wind speed;

sensing a fire condition; and, spraying a fire retardant fluid on the wood shingle roof, wherein a composition of said fire retardant fluid is dependent upon the wind speed sensed.

19. The method of claim 18 further comprising the steps of:

providing an air flow path between the environment and the attic;

upon the sensing of a fire condition, actuating a closure means positioned in the air flow path for sealing the attic beneath the roof against the inflow of air through said air flow path; and, injecting a fire retardant gas into the attic.

20. The method of claim 18 wherein said step of sensing a fire condition comprises the subsidiary steps of:

sensing a spark with an ultra-violet sensor; and, sensing heat with an infra-red sensor.

21. The system of claim 13 further comprising an automatic logic circuit which is connected to said fire sensor and regulates the operation of said plurality of nozzles.

22. The system of claim 21 further comprising:

a water pressure sensor connected to said logic circuit; and, a water valve control located in said fluid circuit and connected to and operated by said logic circuit.

23. The system of claim 21 further comprising:

a first valve for controlling a flow of fluid from said supply of fire retardant fluid; and, a second valve for controlling a flow of air from said supply of air, wherein said logic circuit is connected to and regulates the operation of said first and second valves.

24. A fire extinguishing system for protecting a building roof, and the attic under the roof from fire, comprising:

a supply of fire retardant fluid;

a first valve for controlling a flow of the fire retardant fluid from said supply of fire retardant fluid;

a supply of water;

a second valve for controlling a flow of the water;

a fluid circuit in which the fire retardant fluid and the water can flow;

a mixing means in said fluid circuit for mixing the fire retardant fluid and the water to form a fire retardant mixture;

a fire sensor for monitoring a fire condition;

a microcomputer which is connected to said fire sensor, said first valve and said second valve, for regulating the operation of said first and second valves; and, a plurality of nozzles mounted on the building and connected to said fluid circuit downstream from said mixing means for spraying the roof with the fire retardant mixture when so directed by said microcomputer.

25. The system of claim 24 further comprising:

a fire retardant gas storage container located in the attic; and, a third valve for regulating the venting of fire retardant gas from said container, said third valve being connected to and controlled by said microcomputer.

26. The system of claim 24 further comprising:

a supply of compressed air; and, a fourth valve for regulating the flow of compressed air from said supply of compressed air, said fourth valve being connected to and controlled by said microcomputer.

27. The system of claim 26 further comprising a wind velocity sensor connected to said microcomputer.

28. The system of claim 26 wherein said supply of compressed air comprises a storage tank for storing compressed air, and an air compressor connected to said storage tank for supplying same, and further comprising a pressure sensor in communication with said storage tank, wherein said pressure sensor is in communication with said microcomputer and wherein said compressor is in communication with and controlled by said microcomputer.

29. The system of claim 24 further comprising:

an auxiliary source of water in communication with said fluid circuit;

an auxiliary water select valve located in said fluid circuit;

an auxiliary water pump for pumping water from said auxiliary source of water; and, a water pressure sensor located in said fluid circuit for sensing a pressure of water flowing through said fluid circuit, wherein said auxiliary water selected valve, said auxiliary water pump and said water pressure sensor are connected to and controlled by said microcomputer.

30. The system of claim 24 further comprising:

a ventilation fan extending through the roof and defining an air path into and out of the attic;

a temperature sensor associated with said fan for monitoring an elevated temperature condition in the attic;

a means for activating and deactivating said fan; and, a means for selectively closing the air path of said ventilation fan, wherein said temperature sensor is connected to said microcomputer, and wherein said means for activating and deactivating said fan, and said means for selectively closing the air path are connected to and regulated by said microcomputer.

31. The system of claim 24 further comprising a manually operable control means connected to said microcomputer for overriding said microcomputer.

32. A fire extinguishing system for protecting a building roof, and the attic under the roof from fire, comprising:

a supply of fire retardant fluid;

a first valve for controlling a flow of the fire retardant fluid from said supply of fire retardant fluid;

a supply of air;

a second valve for controlling a flow of the air;

a fluid circuit in which the fire retardant fluid and the air can flow;

a mixing means in said fluid circuit for mixing the fire retardant fluid and the air to form a fire retardant foam mixture;

a fire sensor for monitoring a fire condition;

a microcomputer which is connected to said fire sensor, said first valve and said second valve, for regulating the operation of said first and second valves; and, a plurality of nozzles mounted on the building and connected to said fluid circuit downstream from said mixing means for spraying the roof with the fire retardant foam mixture when so directed by said microcomputer.

33. The system of claim 32 further comprising:

a fire retardant gas storage container located in the attic; and, a third valve for regulating the venting of fire retardant gas from said container, said third valve being connected to and controlled by said microcomputer.

34. The system of claim 32 wherein said supply of air comprises a compressed air source.

35. The system of claim 34 wherein said compressed air source comprises a storage tank for compressed air, and an air compressor connected to said storage tank for supplying same, and further comprising a pressure sensor in communication with said storage tank, wherein said pressure sensor is in communication with said microcomputer and wherein said compressor is in communication with and controlled by said microcomputer.

36. The system of claim 32 further comprising a supply of water which is communicated to said mixing means to provide a water-based foam that is dispensed through said plurality of nozzles.

* * * * *